US006260640B1

(12) United States Patent
Einset et al.

(10) Patent No.: US 6,260,640 B1
(45) Date of Patent: Jul. 17, 2001

(54) AXISYMMETRIC CUTTING ELEMENT

(75) Inventors: Erik Oddmund Einset, Delaware; Mark Steven Deming, Dublin, both of OH (US)

(73) Assignee: General Electric Company, Pittsfield, MA (US)

( * ) Notice: Subject to any disclaimer, the term of this patent is extended or adjusted under 35 U.S.C. 154(b) by 0 days.

(21) Appl. No.: 09/492,095

(22) Filed: Jan. 27, 2000

(51) Int. Cl.[7] ..... E21B 10/36

(52) U.S. Cl. ..... 175/434; 175/420.2

(58) Field of Search ..... 175/425, 426, 175/428, 431, 432, 434, 420.2

(56) References Cited

U.S. PATENT DOCUMENTS 4,255,165 * 3/1981 Dennis et al. .
5,030,276 * 7/1991 Sung et al. .
5,049,164 * 9/1991 Horton et al. .
5,279,375 * 1/1994 Tibbitts et al. .
5,348,108 * 9/1994 Scott et al. .
5,472,376 * 12/1995 Olmstead et al. .
5,590,729 1/1997 Cooley et al. .

FOREIGN PATENT DOCUMENTS

573353 * 9/1977 (SU) .

* cited by examiner

*Primary Examiner*—Roger Schoeppel
(74) *Attorney, Agent, or Firm*—Mueller & Smith, LPA

(57) ABSTRACT

An abrasive compact cutting element includes an axisymmetric superhard abrasive element having a proximal cutting end, an inwardly tapered distal attachment end, and an outer surface; and an axisymmetric cemented carbide support element configured to receive the abrasive element tapered attachment end. The outer surface of the proximal cutting end of the abrasive element is spaced-apart from the outer surface of the carbide support element. The abrasive compact cutting element can be manufactured by forming an axisymmetric annular cemented carbide support element having an upper proximal end, a lower inwardly tapered distal end, and an outer surface. Abrasive particles are disposed in the annular cemented carbide support element. HP/HT processing forms an polycrystalline abrasive particle compact having a proximal cutting end and a tapered distal attachment end which compact is disposed within the annular cemented carbide support element. Cemented carbide is removed from the annular cemented carbide support element about its outer surface to reveal the polycrystalline abrasive compact proximal cutting end which has a outer surface that is spaced-apart from the outer surface of the carbide support element. The corresponding method for manufacturing the abrasive compact forms another aspect of the invention.

12 Claims, 1 Drawing Sheet

AXISYMMETRIC CUTTING ELEMENT

CROSS-REFERENCE TO RELATED APPLICATIONS

None

STATEMENT REGARDING FEDERALLY SPONSORED RESEARCH & DEVELOPMENT

Not applicable.

BACKGROUND OF THE INVENTION

The present invention relates to abrasive compact cutting elements and more particularly to an axisymmetric abrasive compact cutting element wherein the polycrystalline abrasive extends into the carbide support. A simplified manufacturing process for such abrasive compact cutting elements also forms an aspect of the present invention. Such cutting elements have special utility in drill bits for oil and gas exploration and in mining applications.

A compact may be characterized generally as an integrally-bonded structure formed of a sintered, polycrystalline mass of abrasive particles, such as diamond or cubic boron nitride (CBN). Although such compacts may be self-bonded without the aid of a bonding matrix or second phase, it generally is preferred, as is discussed in U.S. Pat. Nos. 4,063,909 and 4,60,423, to employ a suitable bonding matrix which usually is a metal such as cobalt, iron, nickel, platinum, titanium, chromium, tantalum, copper, or an alloy or mixture thereof. The bonding matrix, which is provided at from about 5% to 35% by volume, additionally may contain recrystallization or growth catalyst such as aluminum for CBN or cobalt for diamond.

For many applications, it is preferred that the compact is supported by its bonding to substrate material to form a laminate or supported compact arrangement. Typically, the substrate material is provided as a cemented metal carbide which comprises, for example, tungsten, titanium, or tantalum carbide particles, or a mixture thereof, which are bonded together with a binder of between about 6% to about 25% by weight of a metal such as cobalt, nickel, or iron, or a mixture or alloy thereof. As is shown, for example, in U.S. Pat. Nos. 3,381,428; 3,852,078; and 3,876,7512, compacts and supported compacts have found acceptance in a variety of applications as parts or blanks for cutting and dressing tools, as drill bits, and as wear parts or surfaces.

The basic high pressure/high temperature (HP/HT) method for manufacturing the polycrystalline compacts and supported compacts of the type herein involved entails the placing of an unsintered mass of abrasive, crystalline particles, such as diamond or CBN, or a mixture thereof, within a protectively shielded metal enclosure which is disposed within the reaction cell of an HT/HP apparatus of a type described further in U.S. Pat. Nos. 2,947,611; 2,941,241; 2,941,248; 3,609,818; 3,767,371; 4,289,503; 4,673,414; and 4,954,139. Additionally placed in the enclosure with the abrasive particles may be a metal catalyst if the sintering of diamond particles is contemplated, as well as a pre-formed mass of a cemented metal carbide for supporting the abrasive particles and to thereby form a supported compact therewith. The contents of the cell then are subjected to processing conditions selected as sufficient to effect intercrystalline bonding between adjacent grains of abrasive particles and, optionally, the joining of sintered particles to the cemented metal carbide support. Such processing conditions generally involve the imposition for about 3 to 120 minutes of a temperature of at least 1300° C. and a pressure of at least 20 Kbar.

Regarding the sintering of polycrystalline diamond (PCD) compacts or supported compacts, the catalyst metal may be provided in a pre-consolidated form disposed adjacent the crystal particles. For example, the metal catalyst may be configured as an annulus into which is received a cylinder of abrasive crystal particles, or as a disc which is disposed above or below the crystalline mass. Alternatively, the metal catalyst, or solvent as it is also known, may be provided in a powdered form and intermixed with the abrasive crystalline particles, or as a cemented metal carbide or carbide molding powder which may be cold pressed into shape and wherein the cementing agent is provided as a catalyst or solvent for diamond recrystallization or growth. Typically, the metal catalyst is selected from cobalt, iron, or nickel, or an alloy or mixture thereof, but other metals such as ruthenium, rhodium, palladium, chromium, manganese, tantalum, copper, and alloys and mixtures thereof also may be employed.

Under the specified HT/HP conditions, the metal catalyst, in whatever form provided, is caused to penetrate or "sweep" into the abrasive layer by means of either diffusion or capillary action, and is thereby made available as a catalyst or solvent for recrystallization or crystal intergrowth. The HT/HP conditions, which operate in the diamond stable thermodynamic region above the equilibrium between diamond and graphite phases, effect a compaction of the abrasive crystal particles which is characterized by intercrystalline diamond-to-diamond bonding wherein parts of each crystalline lattice are shared between adjacent crystal grains. Preferably, the diamond concentration in the compact or in the abrasive table of the supported compact is at least about 70% by volume. Methods for making diamond compacts and supported compacts are more fully described in U.S. Pat. Nos. 3,142,746; 3,745,623; 3,609,818; 3,850,591; 4,394,170; 4,403,015; 4,797,326; and 4,954,139.

Regarding the sintering of polycrystalline CBN (PCBN) compacts and supported compacts, such compacts and supported compacts are manufactured in general accordance with the methods suitable for diamond compacts. However, in the formation of CBN compacts via the previously described "sweep-through" method, the metal that is swept through the crystalline mass need not necessarily be a catalyst or solvent for CBN recrystallization. Accordingly, a polycrystalline mass of CBN may be joined to the cobalt-cemented tungsten carbide substrate by the sweep through of the cobalt from the substrate and into the interstices of the crystalline mass notwithstanding that cobalt is not a catalyst or solvent for the recrystallization of CBN. Rather, the interstitial cobalt functions as a binder between the polycrystalline CBN compact and the cemented tungsten carbide substrate.

As it was for diamond, the HT/HP sintering process for CBN is effected under conditions in which CBN is the thermodynamically stable phase. It is speculated that under these conditions, intercrystalline bonding between adjacent crystal grains also is effected. The CBN concentration in the compact or in the abrasive table of the supported compact is preferably at least about 50% by volume. Methods for making CBN compacts and supported compacts are more fully described in U.S. Pat. Nos. 2,947,617; 3,136,615; 3,233,988; 3,743,489; 3,745,623; 3,831,428; 3,928,219; 4,188,194; 4,289,503; 4,673,414; 4,797,326;

and 4,954,139. Exemplary CBN compacts are disclosed in U.S. Pat. No. 3,767,371 to contain greater than about 70% by volume of CBN and less than about 30% by volume of a binder metal such as cobalt.

As disclosed and shown in the prior art, the polycrystalline diamond layer covers the complete cutting surface of the abrasive cutting elements that are employed in a rotary drill, drag, percussion, or machining bits. Rotary drill bits also are known as roller cones. The diamond layer extends to the surface of the drill bit holding the cutting elements. This is shown in U.S. Pat. Nos. 4,109,737 and 5,329,854. Simply, the diamond layer covers the entire exposed (cutting) surface or radius of the exposed end of the cutting or abrading element.

BRIEF SUMMARY OF THE INVENTION

An abrasive compact cutting element includes an axisymmetric superhard abrasive element having a proximal cutting end, an inwardly tapered distal attachment end, and an outer surface; and an axisymmetric cemented carbide support element configured to receive the abrasive element tapered attachment end. The outer surface of the proximal cutting end of the abrasive element is spaced-apart from the outer surface of the carbide support element. The abrasive compact cutting element can be manufactured by forming an axisymmetric annular cemented carbide support element having an upper proximal end, a lower inwardly tapered distal end, and an outer surface. Abrasive particles are disposed in the annular cemented carbide support element. HP/HT processing forms an polycrystalline abrasive particle compact having a proximal cutting end and a tapered distal attachment end which compact is disposed within the annular cemented carbide support element. Cemented carbide is removed from the annular cemented carbide support element about its outer surface to reveal the polycrystalline abrasive compact proximal cutting end which has a outer surface that is spaced-apart from the outer surface of the carbide support element.

The corresponding method for manufacturing an abrasive compact cutting element commences by forming an axisymmetric annular cemented carbide support element having an upper proximal end, a lower inwardly tapered distal end, and an outer surface. Abrasive particles are disposed in the annular cemented carbide support element. The abrasive particles and annular cemented carbide support element then are subjected to HP/HT processing to form an polycrystalline abrasive particle compact having a proximal cutting end and a tapered distal attachment end and being disposed within said annular cemented carbide support element. Finally, the cemented carbide is removed from the annular cemented carbide support element about its outer surface to reveal the polycrystalline abrasive compact proximal cutting end which has an outer surface that is spaced-apart from the outer surface of said carbide support element.

BRIEF DESCRIPTION OF THE DRAWINGS

For a fuller understanding of the nature and objects of the present invention, reference should be had to the following detailed description taken in connection with the accompanying drawings in which.

The drawings will be described below.

DETAILED DESCRIPTION OF THE INVENTION

In drilling applications, common failure modes of the abrasive compact cutting elements include continuous wear of the PCD, impact damage of the PCD caused by high loads either parallel or perpendicular to the PCD carbide interface, and thermally induced damage resulting from overheating of either the PCD or the carbide substrate. The useful life of a cutter is spent once the area of the PCD is reduced by approximately one-third of its original size. The stresses contained within a cutter constituted of a carbide substrate and a PCD layer can reduce performance of the cutter during drilling operations.

The configuration of the inventive cutting elements increase the effective thickness of the PCD layer by modifying the shape of the PCD/WC interface. Concomitant therewith, the inventive cutting elements exhibit a solid piece of PCD at the working surface. With such configuration, the shape of the PCD working surface is not limited. Thus, the PCD working surface can be cylindrical, domed, chisel, sawtooth, or any other configuration while maintaining the increased axisymmetric PCD/WC interface.

Figure 1:
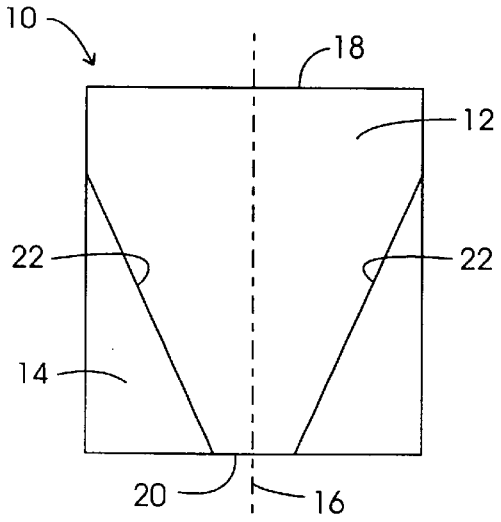
FIG. 1 is a simplified cross-sectional elevational view of an abrasive compact cutting element of the present invention.
Figure 2:
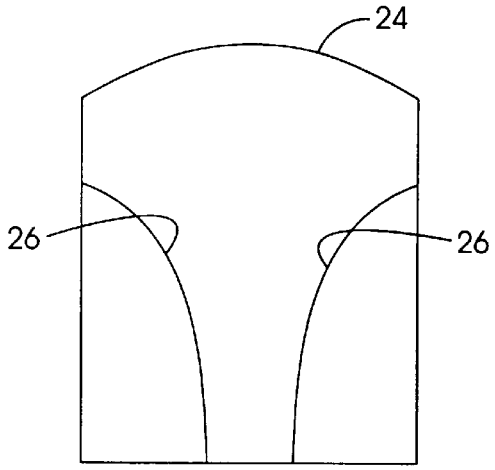
FIG. 2 is a simplified cross-sectional elevational view of another embodiment of the abrasive compact cutting element of the present invention.
Figure 3:
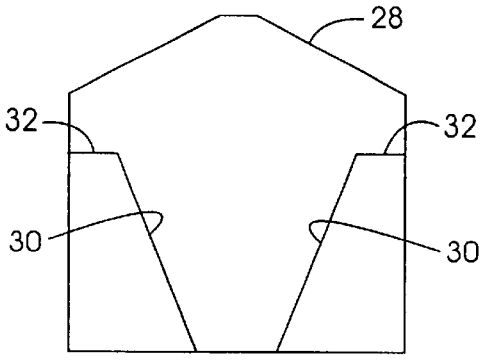
FIG. 3 is a simplified cross-sectional elevational view of another embodiment of the abrasive compact cutting element of the present invention.

Referring now to FIG. 1, cutting element or cutter 10 is shown in simplified cross-sectional elevational view. Cutter 10 is composed of abrasive compact element 12 and carbide support 14. Cutter 10 is axisymmetric in configuration about axis 16. It will be observed that abrasive compact element 12 has proximal working surface 18 that is spaced-apart from support 14 its entire extent. Even on the sides of surface 18, support 14 is spaced-apart from working surface 18. The configuration of abrasive compact element 12, however, calls for tapered distal attachment end 20 to penetrate into and be securely held by support 14. In FIG. 1, interface 22 is shown to be conical. Surface 18 is shown as the end of a cylinder. It will be appreciated that both interface 22 and surface 18 could have other configurations. FIGS. 2 and 3 show additional configurations. In FIG. 2, working surface 24 is shown to be domed for forming a dome cutter. Interface 26 is shown to be hyperbolic-like in shape; although, any curvilinear shape may be employed. In FIG. 3, working surface 28 is shown to be chisel for forming a chisel cutter. Interface 30 is shown to be conical at its lower end with step or land 32 at its upper end. The skilled artisan will appreciate that a variety of additional shapes of working surfaces and of interfaces could be envisioned for use with the cutting elements disclosed herein provided that the interface and support are spaced apart from the working surface.

Figure 4:
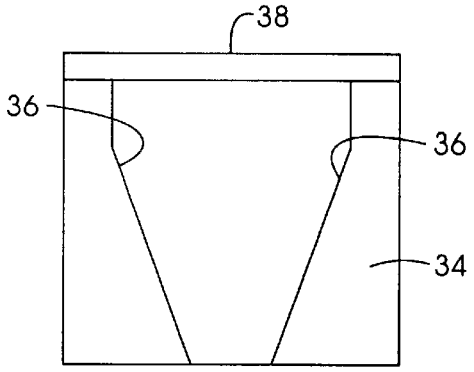
FIG. 4 is a simplified cross-sectional elevational view of showing the abrasive compact cutting element of the present invention in an early stage of fabrication.

In manufacturing the cutting elements, reference is made to FIG. 4 which shows cutting element 10 in an earlier manufacturing stage. Specifically, cutter 10 is fabricated by first forming support 34 in substantially larger dimensions that support 14. Polycrystalline diamond (PCD) or other abrasive particles are placed with support 34 and catalyst/sintering aid disk 38 (typically, Co) is placed thereupon. This entire assembly, then, is subjected to high pressure/high temperature (HP/HT) processing to form sintered compact 36. Next, the outside diameter of support 34 is ground down to reveal proximal working surface 18 while leaving distal attachment end 29 securely bound within support ring 14. Such fabrication and grinding operations are relatively easy operations to perform to produce cutting element 10. The placement of catalyst/sintering aid disk 38 atop the PCD/support structure for axial flow-through ensures good intercrystal bonding of the PCD compact and good bonding to support 34.

The polycrystalline abrasive compact layer preferably is polycrystalline diamond (PCD). However, other materials that are included within the scope of this invention are synthetic and natural diamond, cubic boron nitride (CBN), wurtzite boron nitride, combinations thereof, and like materials. Polycrystalline diamond is the preferred polycrystalline layer. The cemented metal carbide substrate is conventional in composition and, thus, may be include any of the Group IVB, VB, or VIB metals, which are pressed and sintered in the presence of a binder of cobalt, nickel or iron, or alloys thereof. The preferred metal carbide is tungsten carbide.

While the invention has been described and illustrated in connection with certain preferred embodiments thereof, it will be apparent to those skilled in the art that the invention is not limited thereto. Accordingly, it is intended that the appended claims cover all modifications which are within the spirit and scope of this invention. All references cited herein are expressly incorporated herein by reference.

EXAMPLE

Two different small cutters were fabricated and tested in abrasion: a conventional "wave" cutter which is a 19 mm diameter cutter with a 0.079 mm average diamond table thickness (6 ridges extending across the cutter face to form a "wave", and an inventive 10 mm cutter like that depicted in FIG. 1. In order to evaluate the performance of such cutting elements, samples were tested as fabricated and after stress corrosion cracking (SCC) was induced. SCC induction was accomplished by dipping the sample cutting elements into molten (7000° C.) braze for 30 minutes. Such thermal excursion is known to induce SCC in WC supported PCD cutting elements. It is expected that the performance of the cutting elements should be reduced after SCC is induced. This diminution in performance is known as "knockdown."

Tests were performed using a simple rotating lathe and workpiece assembly using Barre Granite (class 3 gray) under the following test conditions:

| | |
|---|---|
| Workpiece | Barre Granite (class 3 gray) |
| Surface Speed | 300 sfpm |
| Feed rate | 0.011 in/min |
| Depth of cut | 0.020 in. |
| Rake angle | −10° |
| Time | 10 min |
| Coolant | Water with rust inhibitor |
| Abrasion Number | Volume removed/Area of Tool Wear |

The following data were recorded:

TABLE 1

| | Abrasion Number | | |
|---|---|---|---|
| Cutting Element | Pre-SCC | Post-SCC | % Knockdown |
| Wave Cutter | 5118 | 3584 | 30 |
| Inventive Cutter | 3150 | 2755 | 12 |

These data show that the inventive cutter experienced less abrasion knockdown than did the prior art wave cutter.

What is claimed is:

1. An abrasive compact cutting element, which comprises:

(a) an axisymmetric superhard abrasive element having a proximal cutting end, an inwardly tapered distal attachment end, and an outer surface; and (b) an axisymmetric annular cemented carbide support element configured to receive said abrasive element tapered attachment end and having an outer surface, said outer surface of said proximal cutting end of said abrasive element being spaced-apart from said outer surface of said carbide support element.

2. The abrasive compact cutting element of claim 1, wherein said superhard abrasive element is one or more of polycrystalline diamond (PCD) or cubic boron nitride (CBN).

3. The abrasive compact cutting element of claim 2, wherein a sintering aid/catalyst is used to bond said PCD, wherein said sintering aid/catalyst is one or more of cobalt, iron, nickel, platinum, titanium, chromium, tantalum, copper, or an alloy or mixture thereof.

4. The abrasive compact cutting element of claim 1, wherein said carbide support is one or more of tungsten carbide, titanium carbide, or tantalum carbide.

5. The abrasive compact cutting element of claim 1, wherein said proximal cutting end is one or more of cylindrical, domed, chisel, or sawtooth in shape.

6. A method for manufacturing an abrasive compact cutting element, which comprises the steps of:

(a) forming an axisymmetric annular cemented carbide support element having an upper proximal end, a lower inwardly tapered distal end, and an outer surface;

(b) disposing abrasive particles in said annular cemented carbide support element;

(c) subjecting said abrasive particles and annular cemented carbide support element to HP/HT processing to form an polycrystalline abrasive particle compact having a proximal cutting end and a tapered distal attachment end and being disposed within said annular cemented carbide support element; and (d) removing cemented carbide from said annular cemented carbide support element about its outer surface to reveal said polycrystalline abrasive compact proximal cutting end which has an outer surface that is spaced-apart from said outer surface of said carbide support element.

7. The method of claim 6, wherein said abrasive particles are diamond and a catalyst/sintering aid material is disposed adjacent to said abrasive particles disposed in said annular support element.

8. The method of claim 7, wherein said catalyst/sintering aid material is placed at said proximal end of said annular support element.

9. The method of claim 7, wherein said sintering aid/catalyst used to bond said PCD is one or more of cobalt, iron, nickel, platinum, titanium, chromium, tantalum, copper, or an alloy or mixture thereof.

10. The method of claim 6, wherein said abrasive particles are one or more of polycrystalline diamond (PCD) or cubic boron nitride (CBN).

11. The method of claim 6, wherein said carbide support is one or more of tungsten carbide, titanium carbide, or tantalum carbide.

12. The method of claim 6, wherein said proximal cutting end is one or more of cylindrical, domed, chisel, or sawtooth in shape.

* * * * *